US012352549B2

(12) United States Patent
Graber et al.

(10) Patent No.: US 12,352,549 B2
(45) Date of Patent: Jul. 8, 2025

(54) NON-PYROTECHNIC DIVERSIONARY DEVICE

(71) Applicant: PavaShot, Inc, Woodburn, IN (US)

(72) Inventors: Curtis E. Graber, Woodburn, IN (US); Jonathan S. Willson, Cecil, OH (US)

(73) Assignee: PavaShot, Inc., Woodburn, IN (US)

( * ) Notice: Subject to any disclaimer, the term of this patent is extended or adjusted under 35 U.S.C. 154(b) by 41 days.

(21) Appl. No.: 18/446,962

(22) Filed: Aug. 9, 2023

(65) Prior Publication Data

US 2025/0052551 A1 Feb. 13, 2025

(51) Int. Cl.
*F42B 8/26* (2006.01)
*F42B 12/36* (2006.01)

(52) U.S. Cl.
CPC ..... *F42B 8/26* (2013.01); *F42B 12/36* (2013.01)

(58) Field of Classification Search
None
See application file for complete search history.

(56) References Cited

U.S. PATENT DOCUMENTS 8,117,966 B1 * 2/2012 Graber ..... F42B 8/26 102/498
8,485,101 B2 * 7/2013 Frank ..... F42B 12/40 102/498
8,904,940 B1 * 12/2014 Pann ..... F42B 12/46 102/370
8,925,538 B2 * 1/2015 Chong ..... F42B 12/36 102/370
10,443,992 B2 * 10/2019 Cayer ..... F42B 4/04

* cited by examiner

*Primary Examiner* — Reginald S Tillman, Jr.
(74) *Attorney, Agent, or Firm* — TAYLOR & EDELSTEIN, PC

(57) ABSTRACT

A diversionary device including a triggering mechanism, a payload and a compressed gas container containing a compressed gas. The compressed gas is non-flammable. The triggering mechanism is coupled to the compressed gas container, and conveys at least some of the gas from the compressed gas container to the payload after a predetermined delay after the triggering mechanism is activated. The gas conveyed to the payload causes the payload to produce a diversionary acoustic effect.

17 Claims, 8 Drawing Sheets

NON-PYROTECHNIC DIVERSIONARY DEVICE

BACKGROUND OF THE INVENTION

1. Field of the Invention

The present invention relates to a diversionary device and specifically to a diversionary device that does not contain an explosive charge.

2. Description of the Related Art

Flash bang and stun grenades are widely employed by military and law enforcement personnel to effect a distracting, a disorientating and/or a diversionary impact on people in order to provide a tactical advantage to those employing such a device. Several patents disclose diversionary devices. For example, U.S. Pat. No. 4,947,753 (Nixon) discloses a stun grenade that produces a non-lethal explosion. This stun grenade includes an elongated body having a hollow interior with an explosive substance located therein. The stun grenade further includes an igniter fuse attached to the grenade body for creating an ignition spark to cause the explosive substance to explode in a non-lethal manner.

U.S. Pat. No. 5,654,523 (Brunn) discloses a stun grenade that generates an explosion accompanied by light and/or blaring sound. The stun grenade has a cartridge that includes an explosive charge located in a housing that has a plurality of vents angularly offset from a longitudinal axis of a cavity in the housing. The vents allow for a radial discharge of the explosive from the housing. The explosives may be connected to a tear gas container allowing for the dispersal of tear gas upon the discharge of the explosives.

U.S. Pat. No. 6,253,680 (Grubelich) discloses a diversionary device having a housing with an opening. The housing contains a non-explosive propellant, a quantity of fine powder and a means of activating the propellant, which in turn, drives the fine powder through the opening, so that an igniter ignites the fine powder, as the powder travels through the opening in order to create a diversionary flash and bang.

The prior art is directed to the use of pyrotechnic and the use of chemical exothermic charges to effect the diversionary effect.

What is needed in the art is a diversionary device that does not ignite any substance or rely on a chemical reaction as it provides a diversionary action.

SUMMARY OF THE INVENTION

The present invention provides a completely non-pyrotechnical diversionary device, with at least part of the diversion being a high decibel explosion type sound.

The present invention in one form is a diversionary device including a triggering mechanism, a payload and a compressed gas container containing a compressed gas. The compressed gas is non-flammable. The triggering mechanism is coupled to the compressed gas container, and conveys at least some of the gas from the compressed gas container to the payload after a predetermined delay after the triggering mechanism is activated. The gas conveyed to the payload causes the payload to produce a diversionary acoustic effect.

The present invention in another form is directed to a method of operating a diversionary device including the steps of: activating a triggering mechanism coupled to a payload; and conveying at least some gas from a compressed gas container to the payload after a predetermined delay after the triggering mechanism is activated, the gas conveyed to the payload causing the payload to produce a diversionary acoustic effect.

The present invention advantageously does not utilize any pyrotechnic technique to produce the acoustic effect.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
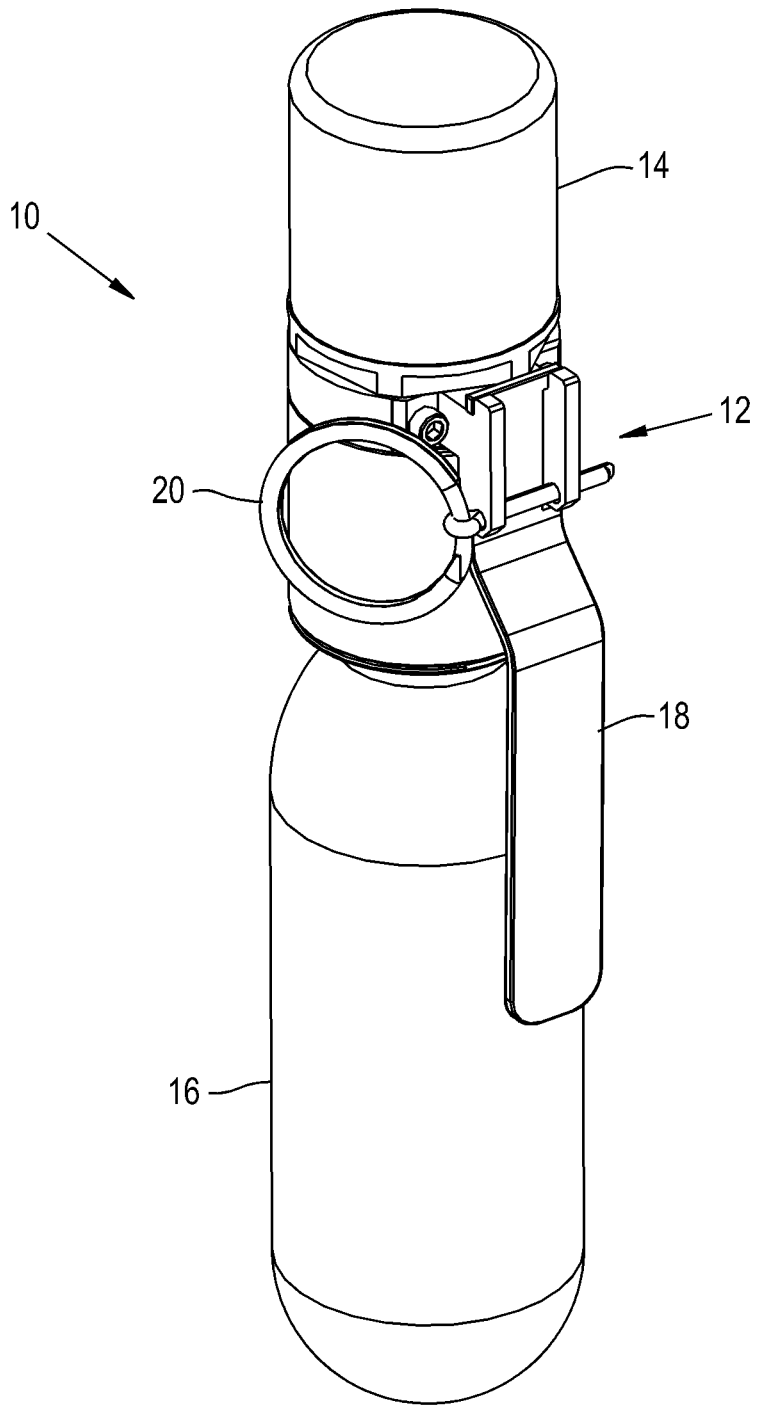
FIG. 1 is a perspective view of an embodiment of a non-pyrotechnical diversionary device of the present invention.
Figure 2:
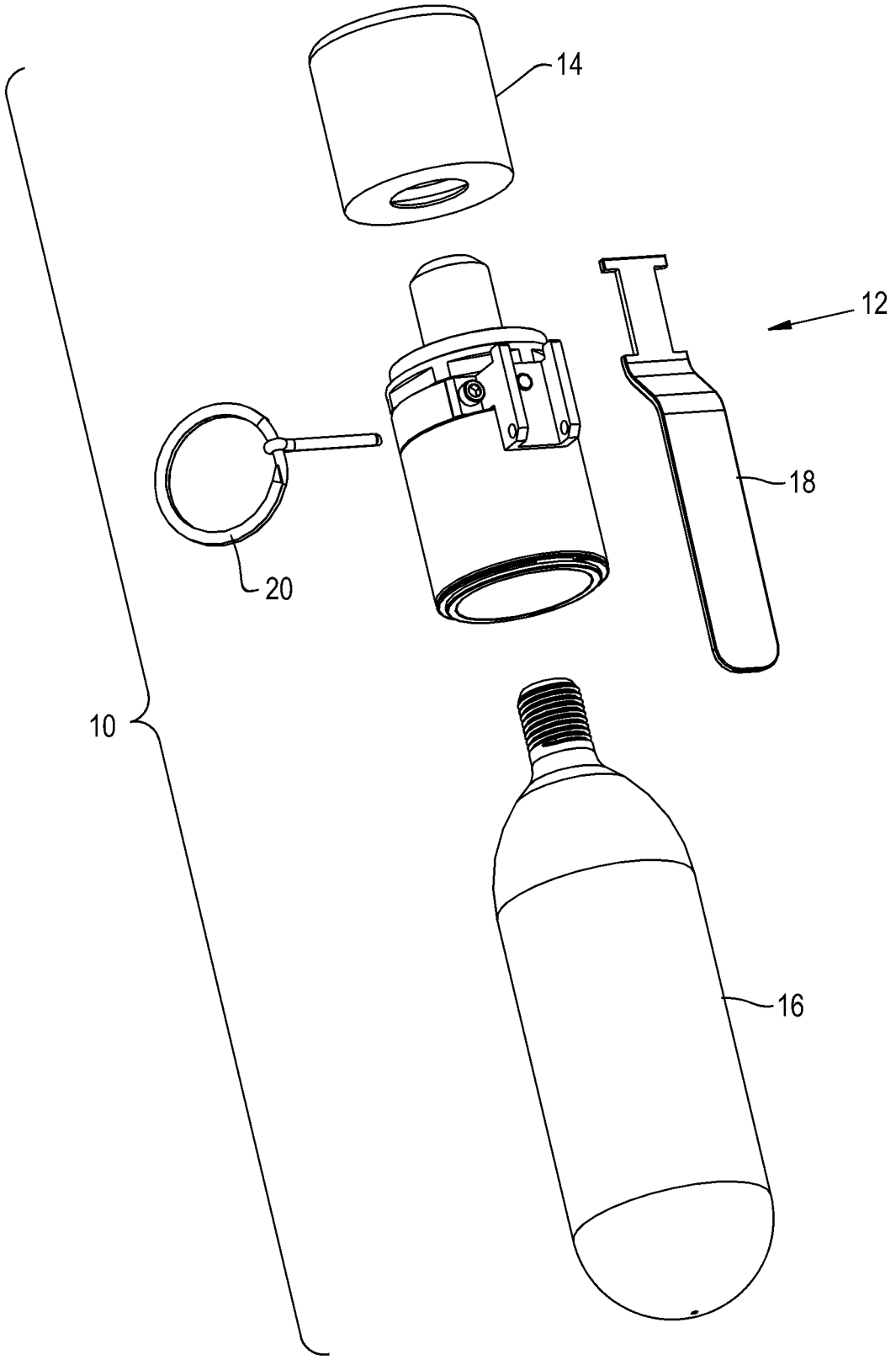
FIG. 2 is an exploded perspective view of the non-pyrotechnical diversionary device of FIG. 1.
Figure 3:
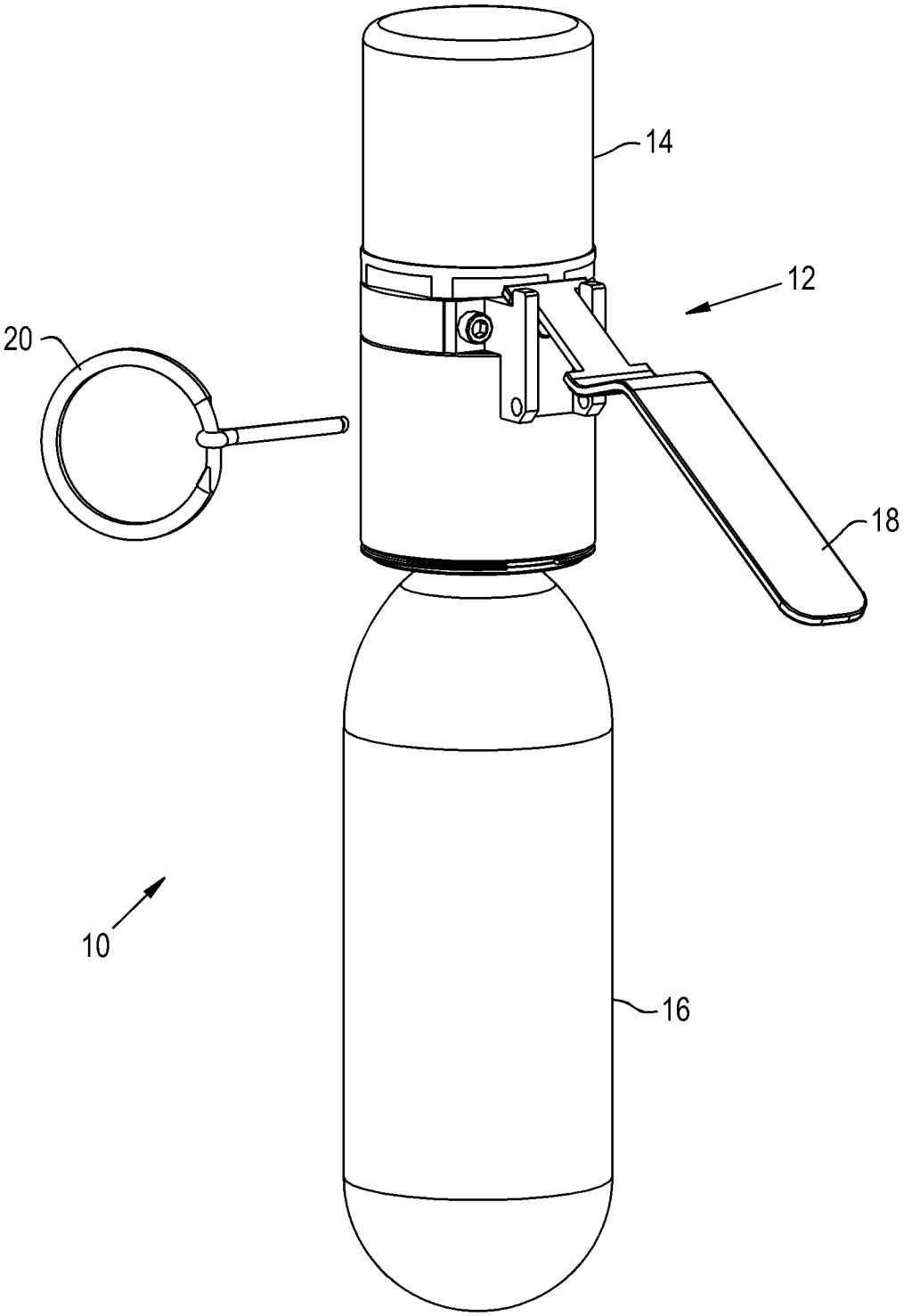
FIG. 3 is a side view of the non-pyrotechnical diversionary device of FIGS. 1 and 2.

Referring now to the drawings, and more particularly to FIGS. 1-3, there is shown a non-pyrotechnical diversionary device (NPDD) 10 of the present invention having a triggering mechanism 12, a payload 14 and a compressed gas container 16. Compressed gas container 16 contains a compressed gas G that is non-flammable, such as carbon dioxide.

Triggering mechanism 12 is coupled to compressed gas container 16 and to payload 14. Triggering mechanism 12 is configured to convey at least some of gas G from compressed gas container 16 to payload 14 after a predetermined delay after triggering mechanism 12 is activated. The gas G that is conveyed to payload 14 causes a portion of payload 14 to expand and to produce a desired diversionary acoustic effect.

Triggering mechanism 12 includes an activating lever 18 and a safety pin 20. Activating lever 18 and safety pin 20 are familiar elements to grenade type devices and serve similar purposes. Safety pin 20 is pulled out of triggering mechanism 12, for example as shown in FIG. 2, and discarded. Activating lever 18 can then be held close to the side of compressed gas container 16 by the hand of the operator until it is decided to activate NPDD 10 by letting go of activating lever 18 allowing it to pivot about an upper portion to start an internal process within triggering mechanism 12 that leads to the diversionary acoustic effect. Once activating lever 18 is released, NPDD 10 is typically thrown to the desired location so that the diversionary effect can take place after the predetermined delay takes place. Activating lever 18 may remain pivotally coupled to the body of triggering mechanism 12 or may disconnect from the body once it pivots from a device safe position.

Now, additionally referring to FIGS. 4-8, there are shown some additional internal details of triggering mechanism 12 including a piston 22, a restricted flow passage 24, a spring biasing member 26, and a seer 28. Piston 22 includes a piercing point 30, a sealing protrusion 32, a seer groove 34, a sealing ring groove 36 and other geometric attributes pictured in the figures. Restricted flow passage 24 is arranged so that some gas G can traverse through passage 24 at a calculated rate of flow of the gas to allow for the predetermined delay of triggering mechanism 12.

Figure 4:
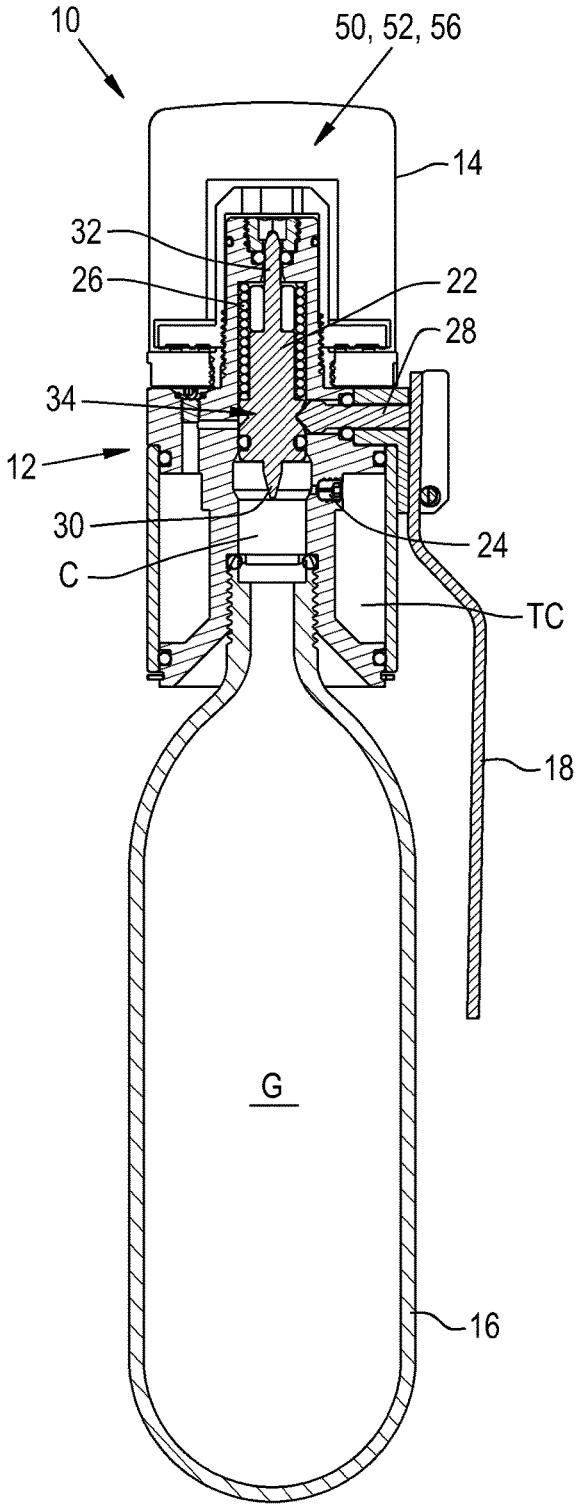
FIG. 4 is a cross-sectional side view of the non-pyrotechnical diversionary device of FIG. 3, illustrating a piston in a first position.

Now looking at FIGS. 4-7 as sequential positions of piston 22, we will discuss the activation of triggering mechanism 12. In FIG. 4, piston 22 is in a first position, where NPDD 10 is in a safe mode. Piston 22 his held in place by seer 28 being positioned in seer groove 34 and activating lever 18 is against one end of seer 28 to hold piston 22 in the position shown in FIG. 4, and safety pin 20 is holding activation lever 18 in position. Piston 22 is restraining the biasing force of spring biasing member 26 as it is in a compressed state.

Figure 5:
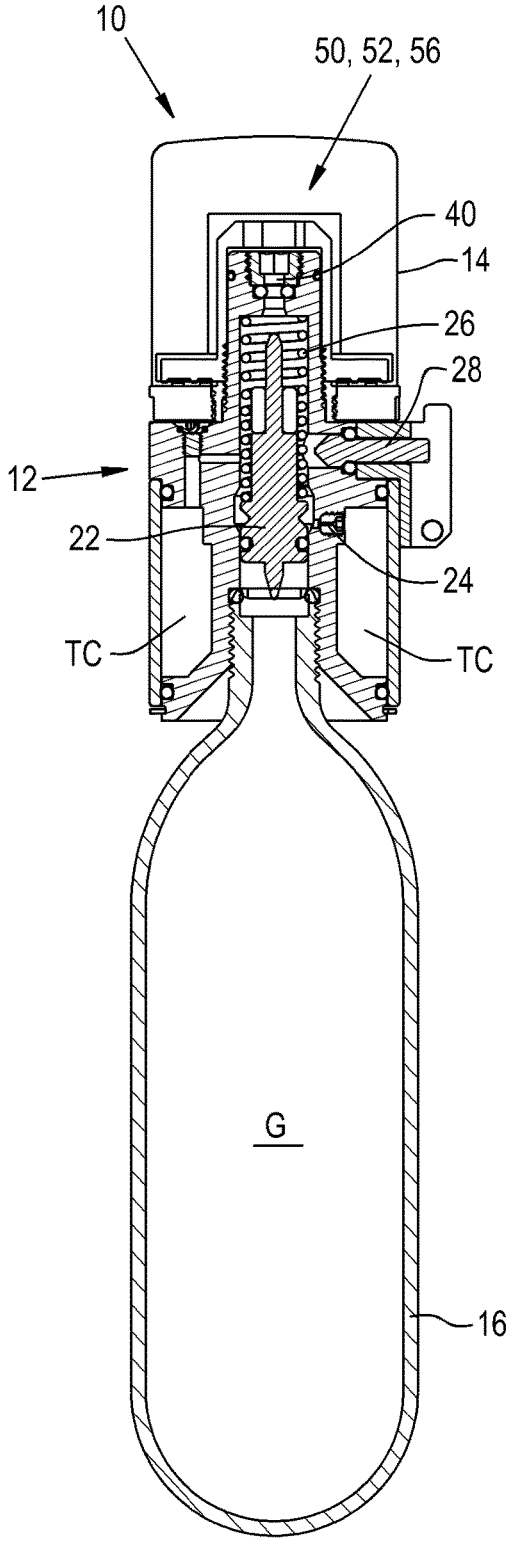
FIG. 5 is a cross-sectional side view of the non-pyrotechnical diversionary device of FIGS. 3 and 4, illustrating the piston in a second position.

In FIG. 5, piston 22 is in a second position with piercing point 30 having been driven through an end of compressed gas container 16. The actions taken between FIG. 4 and FIG. 5 are that safety pin 20 has been discarded and activating lever 18 has moved to allow seer 28 to retract from piston 22. The shape of the end of seer 28 and seer groove 34 are such that the bias of spring 26 forces seer 28 to move away from piston 22 when lever 18 is moved. The biasing force of spring 26 then drives piercing point 30 into the end of compressed gas container 16 such that compressed gas container 16 is punctured as one step in the activation of triggering mechanism 12.

Figure 6:
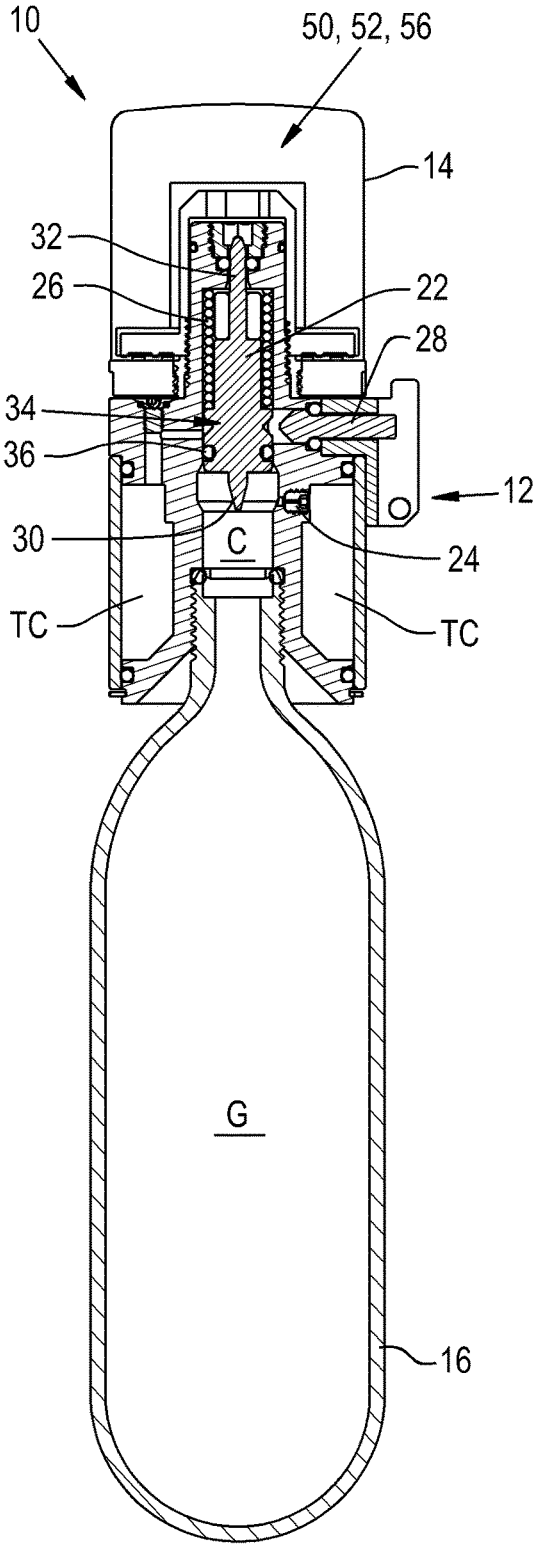
FIG. 6 is a cross-sectional side view of the non-pyrotechnical diversionary device of FIGS. 3-5, illustrating the piston in a third position.

In FIG. 6, piston 22 is in a third position with sealing protrusion 32 extending into a gas passageway 40 of payload 14 to keep gas G from passing on into payload 14. The actions taken between FIG. 5 and FIG. 6, are that the pressure of gas G is such that it drives piston 22 back against the biasing force of spring 26 holding piston 22 approximately where it was in FIG. 4, but gas G has moved into cavity C between piston 22 and the punctured end of compressed gas container 16. Gas G is moving through restricted flow passage 24 into timing cavity TC.

Figure 7:
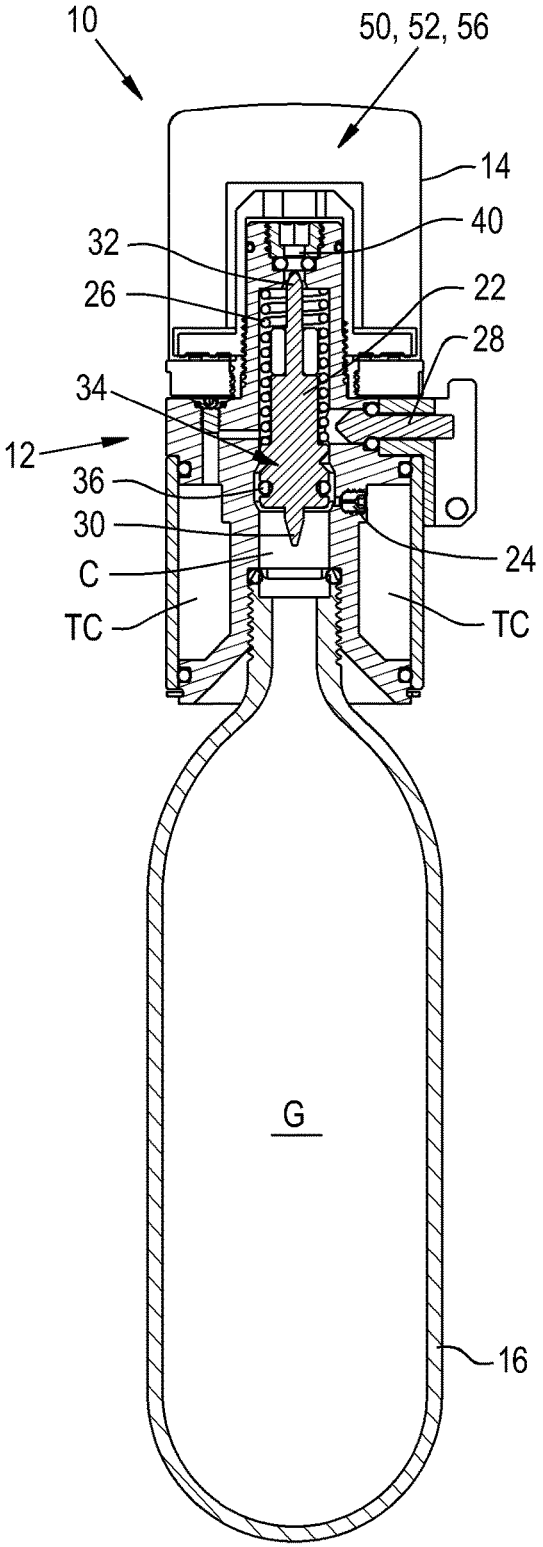
FIG. 7 is a cross-sectional side view of the non-pyrotechnical diversionary device of FIGS. 3-6, illustrating the piston in a fourth position.
Figure 8:
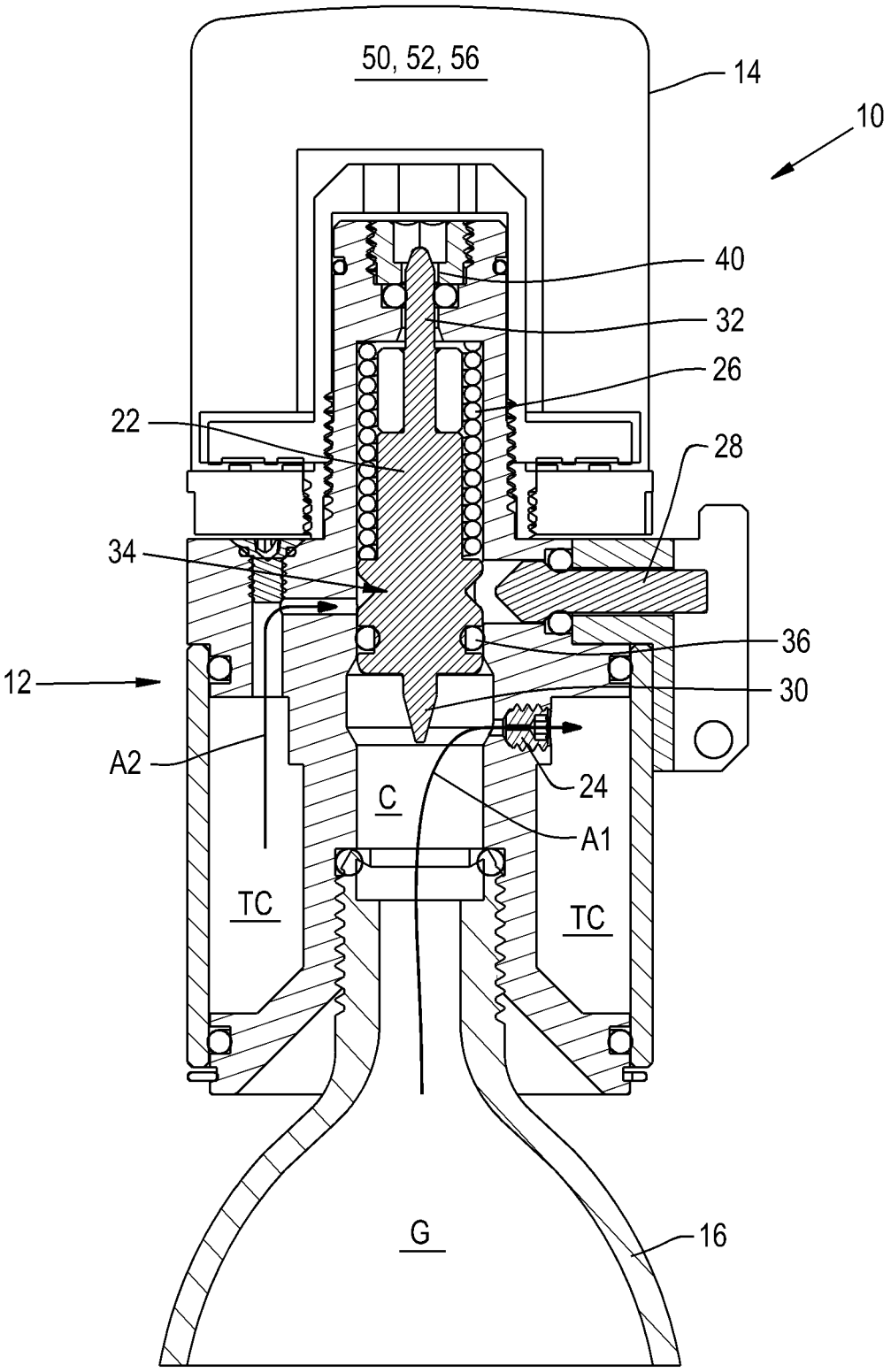
FIG. 8 is a cross-sectional side view of the non-pyrotechnical diversionary device of FIGS. 3-7, illustrating the piston in the third position as shown in FIG. 6, further illustrating a gas flow.

In FIG. 7, piston 22 is in a fourth position with sealing protrusion 32 being removed from gas passageway 40 allowing gas G to flow around sealing ring 36 in a widened portion of cavity C along the sides of piston 22 and spring 26, rapidly entering payload 14. The actions taken between FIGS. 6 and 7, are explained with additional reference to FIG. 8. As gas G flows through restricted flow passage 24, as shown with arrow A1, the pressure in timing cavity TC increases and gas G also flows along a side of piston 22 from timing cavity TC, as shown with arrow A2. This build up of pressure on the top side of sealing ring 36 reduces the relative pressure between the two sides of sealing ring 36 that had driven piston 22 to the third position. With the reduction of pressure difference on each side of piston 22, the bias force of spring 26 again moves piston 22 downward, to where sealing ring 36 is in the widened portion of cavity C, where the rapid flow of gas G toward payload 14 takes place as piston 22 is in this fourth position.

As can be seen restricted flow passage 24 is illustrated as being screwed into place so that different size passages can be selected to determine the length of the predetermined delay that takes place between the third and fourth positions of piston 22. It is also contemplated to have more than one selected restricted flow passage 24 may be included so that the user can alter the delay time by selecting the restricted flow passage 24 that is used.

Piston 22 performs at least three functions with four being listed as:

(1) puncturing compressed gas container 16;
(2) establishing a pathway for the compressed gas to enter timing chamber TC;
(3) establishing a pathway for the compressed gas G to inflate payload 16; and
(4) metered-timing of a gas transfer process of compressed gas G.

Figure 9:
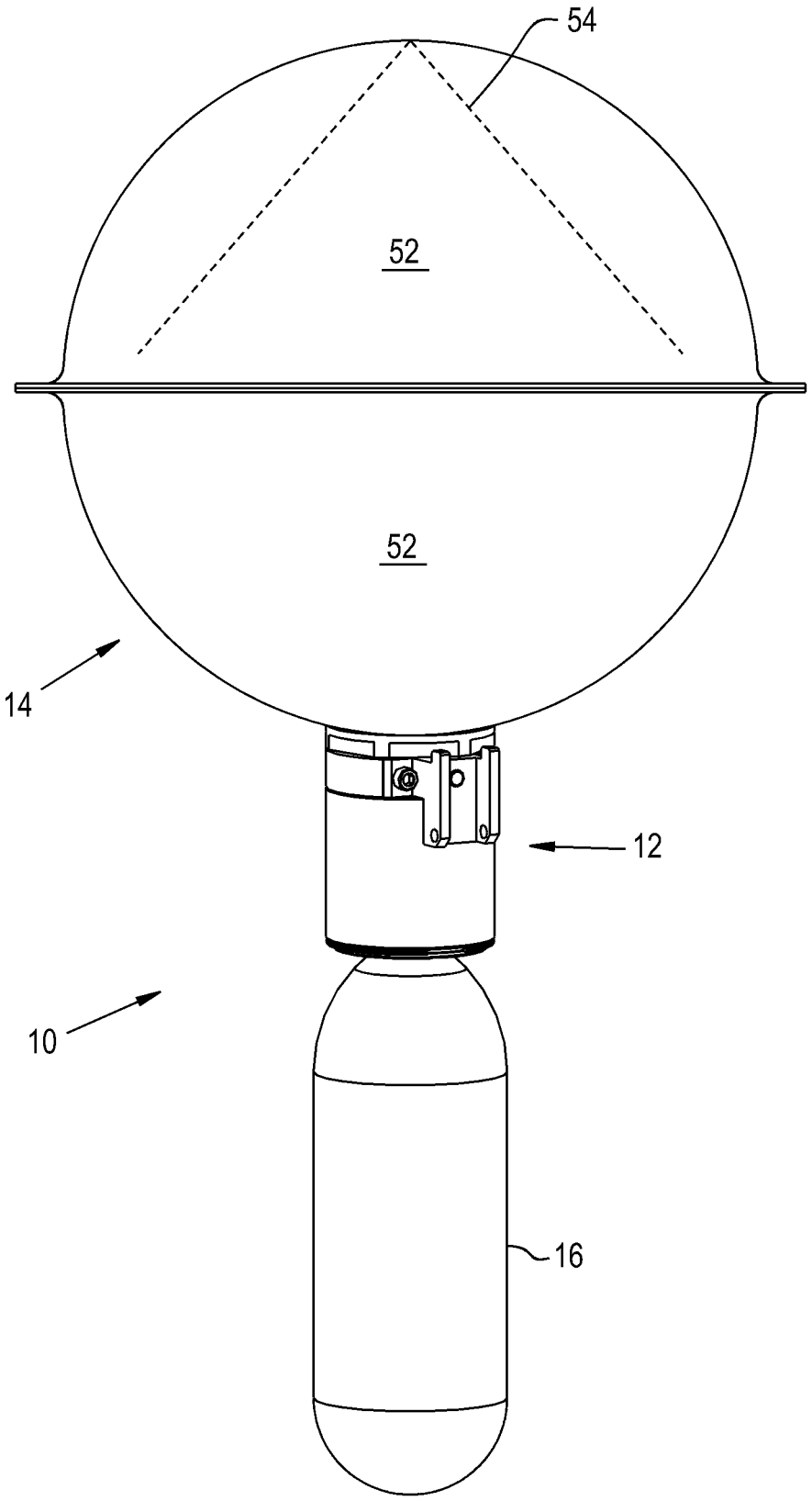
FIG. 9 is a view of the non-pyrotechnical diversionary device of FIGS. 1-8, illustrating a payload that is expanded prior to exploding.
Figure 10:
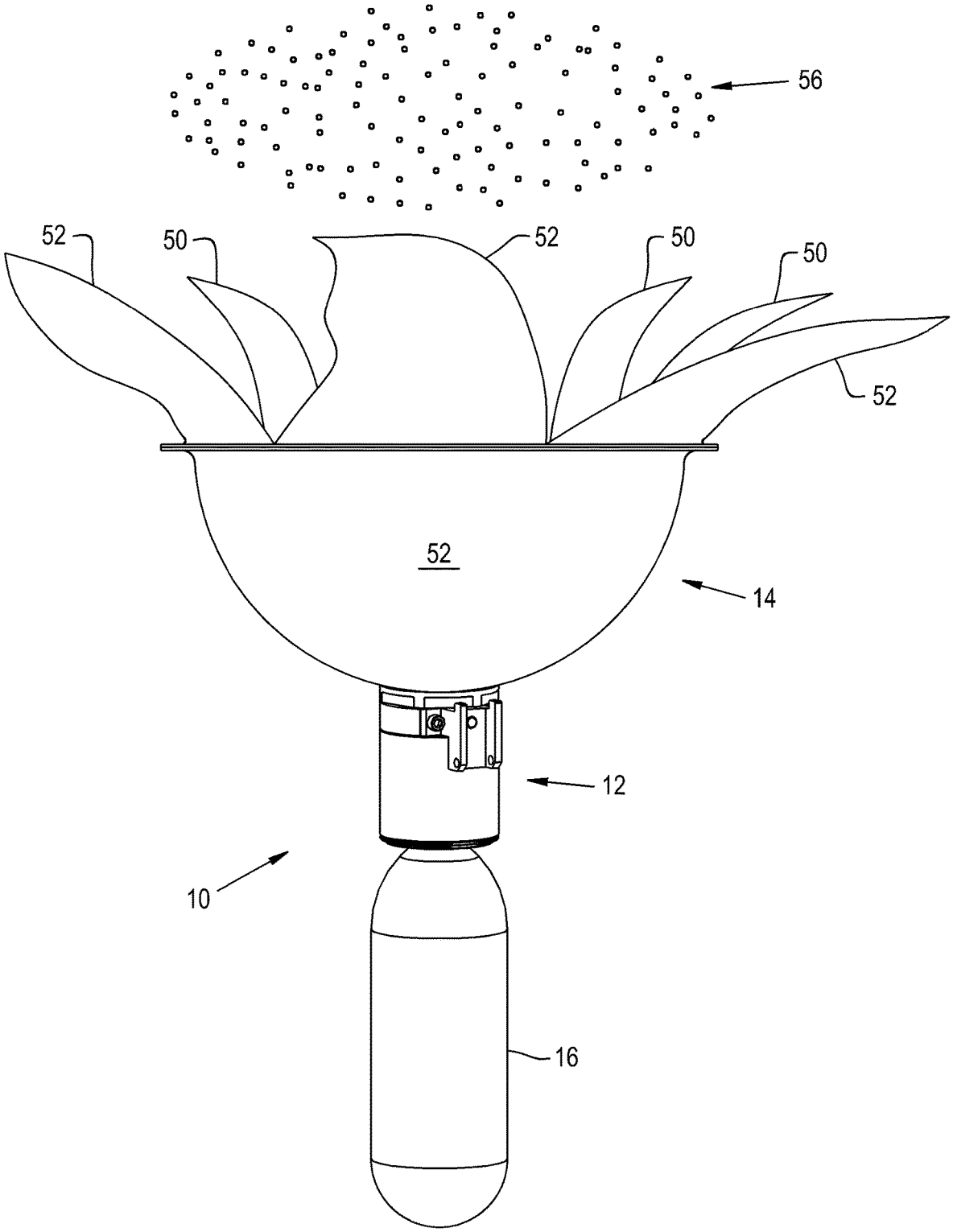
FIG. 10 is a view of the non-pyrotechnical diversionary device of FIGS. 1-9, illustrating the payload envelopes that have expanded and ruptured.

Now, additionally referring to FIGS. 9 and 10, payload 14 includes a first envelope 50 into which the compressed gas is directed, and a second envelope 52 having a predetermined failure pattern 54. First envelope 50 is positioned with second envelope 52. Second envelope 52 can be, for example, a non-expanding fabric envelope 52 and first envelope 50 is an expandable envelope 50. Gas G released within first envelope 50 rapidly expands first envelope 50 reaching the constraints of second envelope 52, as illustrated in FIG. 9. The pressure placed on envelope 52 causes second envelope 52 to fail along the predetermined failure pattern 54 thereby causing an acoustic wave that is the diversionary acoustic effect. Predetermined failure pattern 54 on non-expanding envelope 52 is created by an ablation or a laser material burn process for very repeatable rupture results. The term non-expanding should be understood to mean substantially non-expanding relative to the characteristic of first envelope 50, which expands rapidly when gas G enters therein. The material of second envelope 52 although resistant to expanding, does actually stretch slightly when inflated to burst level pressures, but as stated it is non-expanding as defined herein and results is a rapid rupture as the outer surface of first envelope 50 presses against the inner surface of second envelope 52, as the pressure of gas G is applied to first envelope 50. Additionally, it is contemplated that a single hybrid material could be created that provides the sealed envelope with resistant to expansion properties, as in a combined envelope 50/52. Such a combined envelope would have an engineered cross pattern initiation to allow for repeatability in the bursting function.

Payload 14 may further include a dispersal compound 56 located within the first and/or the second envelope, the dispersal compound being dispersed upon the failure of at least second envelope 52. Dispersal compound 56 may be an irritant of some sort, such as a skin irritant, an eye irritant, or an obnoxious odor. Dispersal compounds 56 or payload media 56 could also include: powder or liquids of various compounds potentially including: simulated smoke, dust, irritants, marking agents, smelly or fragrant mixes, medication, fertilizers, fire abatement compounds, and oxygen displacing agents. While it is the desire to have nonflammable elements in the NPDD 10, it is recognized that it could, contrary to this purpose, contain oxidizer agents, fire ignition agents etc. that are rapidly spread, while being localized with the burst energy of the burst envelope.

One important aspect of the intended construct of NPDD 10 is that it does not include a flammable gas, nor does the device include a chemical exothermic compound.

Advantageously, the single piston 22 with multiple action features provides a cost effective and reliable timing solution to NPDD 10.

Upon the release of seer 28 piston 22 is driven forward to penetrate sealed gas high pressure bottle 16. The gas pressure that is then exerted against piston 22 drives piston 22 to a timing position while timing cavity TC is filled with gas G through a small port 24 to accomplish the timing delay as the gas pressure differential on piston 22 allows the bias of spring 26 to move piston 22 to a firing position. In the firing position piston 22 dumps gas G in timing cavity TC and gas G in pressure vessel 16 quickly to thereby pressurize the burst envelope up to the burst pressure which releases the volume of the burst envelope in a quick catastrophic failure mode of fabric envelope 52 causing a rapid N-wave pressure rise to the localized atmosphere replicating the sound of an conventional explosion event.

As discussed above, timing can vary depending on the orifice 24 used. The delay can nominally be approximately 2 or 3 seconds, and can easily be selected in a range of from about 1 to 5 seconds.

It is also contemplated that the delay time can be impacted by changing the spring pressure, the orifice size, the stored bottle pressure, and the location, shape, area, of functional ports and valves.

NPDD 10 serves as a simulation or emulation of small to medium explosions and/or as training devices used for first responders and military/police training aids and theatrical simulations of explosions. The acoustic report of the envelope, as it ruptures, produces a sheer pressure wave of a rapid pressure rise of no less than 150 db or 630 pascals of overpressure within 0.25 ms to the surrounding ambient air, to thereby produce a shockwave concussion that is both heard and felt. Versions of NPDD 10 can actually produce up to 175 db (11,240 pascal) overpressure within 0.25 ms, with some configurations capable of 180 db (22,440 pascal) of overpressure within 0.25 ms. The diversionary acoustic effect of NPDD 10 is a rapid overpressure rise time shockwave.

It is also contemplated that payload 14 could be another type of acoustic device, such as a noisemaker, perhaps in the form of a whistle, a siren, or an airhorn, for example. Each providing a diversionary acoustic effect when activated.

Another advantage of the present invention is that it will not naturally ignite or exasperate fires and explosions. This is particularly advantageous in the presence of dangerous freight or in atmospheric environments such as ship boarding, meth labs, fuel or gas refinery locations etc.

It is also contemplated that NPDD 10 could be mechanically or electrically triggered with the use of a wired or wireless solenoid assembly to release seer 28.

The failure initiation detail on the outer bag 52 looks like the letter X, so after it blows there are 4 "petals". Generally speaking the inner bladder 50 usually doesn't have petals, it's rupture is more of a ragged edge with a hole in the center.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A diversionary device, comprising:

a triggering mechanism;

a payload including a first and a second envelope, the first envelope being inside the second envelope, the second envelope having a predetermined failure pattern; and a compressed gas container containing a compressed gas, the compressed gas being non-flammable, the triggering mechanism being coupled to the compressed gas container, the triggering mechanism conveying at least some of the gas from the compressed gas container to the first envelope after a predetermined delay after the triggering mechanism is activated, the gas conveyed to the payload causing the payload to produce a diversionary acoustic effect.

2. The diversionary device of claim 1, wherein the triggering mechanism has a restricted flow passage for some of the gas to traverse, a rate of flow of the gas in the restricted flow passage determining the predetermined delay of the triggering mechanism.

3. The diversionary device of claim 2, wherein the triggering mechanism includes a piston biased to puncture the compressed gas container when the triggering mechanism is activated.

4. The diversionary device of claim 3, wherein the piston is at a first position prior to the triggering mechanism being activated and the piston moves to a second position when the triggering mechanism is activated where the piston punctures the compressed gas container, an initial flow of the compressed gas causes the piston to move to a third position until the predetermined delay has expired causing the piston to move to a fourth position.

5. The diversionary device of claim 3, wherein the piston performs multiple functions.

6. The diversionary device of claim 5, wherein the multiple functions include at least three of the following:

(1) puncturing the compressed gas container;

(2) establishing a pathway for the compressed gas to enter a timing chamber;

(3) establishing a pathway for the compressed gas to inflate the payload; and (4) metered-timing of a gas transfer process of the compressed gas.

7. The diversionary device of claim 1, wherein the second envelope is a non-expanding fabric envelope and the first envelope is an expandable envelope, the compressed gas released within the first envelope rapidly expands the first envelope reaching the constraints of the second envelope and causing the second envelope to fail along the predetermined failure pattern thereby causing an acoustic wave that is the diversionary acoustic effect.

8. The diversionary device of claim 7, wherein the payload further includes a dispersal compound located within the first and/or the second envelope, the dispersal compound being dispersed upon the failure of at least the second envelope.

9. The diversionary device of claim 1, wherein the diversionary device does not include a flammable gas, nor does the device include a chemical exothermic compound.

10. A method of operating a diversionary device, comprising the steps of:

activating a triggering mechanism coupled to a payload, the payload including a first envelope inside a second envelope, the second envelope having a predetermined failure pattern; and conveying at least some gas from a compressed gas container to the first envelope after a predetermined delay after the triggering mechanism is activated in the activating step, the gas conveyed to the first envelope causing the payload to produce a diversionary acoustic effect, the diversionary acoustic effect being a rapid overpressure rise time shockwave.

11. The method of operating the diversionary device of claim 10, wherein the triggering mechanism has a restricted flow passage for some of the gas to traverse, a rate of flow of the gas in the restricted flow passage determining the predetermined delay of the triggering mechanism.

12. The method of operating the diversionary device of claim 11, wherein the triggering mechanism includes a piston biased to puncture the compressed gas container when the triggering mechanism is activated.

13. The method of operating the diversionary device of claim 12, wherein the piston is at a first position prior to the triggering mechanism being activated and the piston moving to a second position when the triggering mechanism is activated where the piston punctures the compressed gas container, an initial flow of the compressed gas causing the piston to move to a third position until the predetermined delay has expired causing the piston to then move to a fourth position.

14. The method of operating the diversionary device of claim 12, wherein the piston performs at least three functions.

15. The method of operating the diversionary device of claim 14, wherein the at least three functions include at least three of the following:

(1) puncturing the compressed gas container;

(2) establishing a pathway for the compressed gas to enter a timing chamber;

(3) establishing a pathway for the compressed gas to inflate the payload; and (4) metered-timing of a gas transfer process of the compressed gas.

16. The method of operating the diversionary device of claim 10, wherein the second envelope fails along the predetermined failure pattern thereby causing an acoustic wave that is the diversionary acoustic effect, the rapid overpressure rise time shockwave produces no less than 150 db or 630 pascals of overpressure within 0.25 ms.

17. The method of operating the diversionary device of claim 10, wherein the diversionary device does not include a flammable gas, nor does the device include a chemical exothermic compound.

* * * * *